US008511259B2

(12) United States Patent
Ambrosini et al.

(10) Patent No.: US 8,511,259 B2
(45) Date of Patent: *Aug. 20, 2013

(54) METHOD FOR REDUCING EMISSION OF POLLUTANTS FROM AN INTERNAL COMBUSION ENGINE, AND FUEL EMULSION COMPRISING WATER AND A LIQUID HYDROCARBON

(75) Inventors: Tiziano Ambrosini, Settimo Milanese (IT); Alberto De Amicis, San Donato Milanese (IT); Guido Rivolta, Vigevano (IT); Carlo Andrea Bertoglio, Rapallo (IT)

(73) Assignee: Cam Technologie S.p.A., Pero (Milano) (IT)

( * ) Notice: Subject to any disclaimer, the term of this patent is extended or adjusted under 35 U.S.C. 154(b) by 1301 days.

This patent is subject to a terminal disclaimer.

(21) Appl. No.: 10/509,044

(22) PCT Filed: Mar. 28, 2002

(86) PCT No.: PCT/EP02/03534

§ 371 (c)(1), (2), (4) Date: May 9, 2005

(87) PCT Pub. No.: WO03/083018

PCT Pub. Date: Oct. 9, 2003

(65) Prior Publication Data

US 2005/0217613 A1 Oct. 6, 2005

(51) Int. Cl.
*C10L 1/18* (2006.01)

(52) U.S. Cl.
USPC ..... 123/25 A; 123/568.11; 44/270

(58) Field of Classification Search
USPC ..... 123/25 AB, 25 B, 299, 568.11–568.32; 44/270, 330; 208/15
See application file for complete search history.

(56) References Cited

U.S. PATENT DOCUMENTS 3,501,914 A * 3/1970 Asher ..... 60/39.461
3,732,084 A * 5/1973 Nixon et al. ..... 44/270

(Continued)

FOREIGN PATENT DOCUMENTS

DE 100 03 105 A1 7/2001
EP 0 399 620 A1 11/1990

(Continued)

OTHER PUBLICATIONS

M. Schultz, "Emission Controls: Part II: GM Exhaust Gas Recirculation Systems", Motor, vol. 159, pp. 15-22 and 41, (Feb. 1983).

(Continued)

*Primary Examiner* — M. McMahon
(74) *Attorney, Agent, or Firm* — Finnegan, Henderson, Farabow, Garrett & Dunner, L.L.P.

(57) ABSTRACT

Method for reducing emission of pollutants from an internal combustion engine including at least one combustion chamber. A fuel emulsion is injected into a combustion chamber; the fuel emulsion is ignited in the combustion chamber in the presence of air; and the internal combustion engine is operated so as to reduce peak combustion temperature in the combustion chamber. The fuel emulsion has a liquid hydrocarbon fuel, water, at least one emulsifier and at least one oxygen-containing water soluble organic compound. A considerable reduction of particulate emissions is obtained by using this fuel emulsion while maintaining or even further reducing the NOx level which is already reduced by the engine itself.

16 Claims, No Drawings

(56) References Cited

U.S. PATENT DOCUMENTS

| | | | | |
|---|---|---|---|---|
| 3,756,794 | A * | 9/1973 | Ford | 44/301 |
| 3,796,049 | A | 3/1974 | Hayashi | |
| 4,031,118 | A * | 6/1977 | Miller | 560/198 |
| 4,454,854 | A | 6/1984 | Gotoh et al. | |
| 4,479,473 | A | 10/1984 | Wade | |
| 5,004,479 | A | 4/1991 | Schon et al. | |
| 5,271,370 | A | 12/1993 | Shimada et al. | |
| 5,445,128 | A | 8/1995 | Letang et al. | |
| 5,669,938 | A | 9/1997 | Schwab | |
| 5,820,640 | A * | 10/1998 | Ikura et al. | 44/301 |
| 6,145,498 | A | 11/2000 | Packard et al. | |
| 6,598,584 | B2 * | 7/2003 | Beck et al. | 123/299 |
| 6,606,856 | B1 * | 8/2003 | Brown et al. | 60/299 |
| 6,742,335 | B2 * | 6/2004 | Beck et al. | 60/605.2 |
| 7,018,433 | B2 * | 3/2006 | Rivolta et al. | 44/301 |
| 7,041,145 | B2 * | 5/2006 | Ambrosini et al. | 44/301 |
| 2003/0024852 | A1 * | 2/2003 | Huffer et al. | 208/15 |
| 2003/0084658 | A1 * | 5/2003 | Brown et al. | 60/274 |
| 2004/0092412 | A1 * | 5/2004 | Hueffer et al. | 508/551 |
| 2004/0111955 | A1 * | 6/2004 | Mullay et al. | 44/301 |
| 2004/0154216 | A1 * | 8/2004 | Huffer et al. | 44/385 |
| 2005/0092286 | A1 * | 5/2005 | Sasaki et al. | 123/295 |
| 2005/0120619 | A1 * | 6/2005 | Koch et al. | 44/301 |
| 2006/0218854 | A1 * | 10/2006 | Barbour et al. | 44/331 |
| 2006/0247137 | A1 * | 11/2006 | Boffa | 508/110 |
| 2007/0203372 | A1 * | 8/2007 | Ramakers | 568/867 |

FOREIGN PATENT DOCUMENTS

| | | | |
|---|---|---|---|
| EP | 0 441 002 | A1 | 8/1991 |
| EP | 0 475 620 | A2 | 3/1992 |
| EP | 0 630 398 | B1 | 12/1994 |
| EP | 0 812 615 | A2 | 12/1997 |
| WO | WO 92/19701 | | 11/1992 |
| WO | WO 93/07238 | | 4/1993 |
| WO | WO 97/34969 | | 9/1997 |
| WO | WO 00/15740 | | 3/2000 |
| WO | WO 01/51593 | A1 | 7/2001 |

OTHER PUBLICATIONS

"Bosch Automotive Handbook", $4_{th}$ Edition, pp. 530-535, (Oct. 1996).

* cited by examiner

METHOD FOR REDUCING EMISSION OF POLLUTANTS FROM AN INTERNAL COMBUSION ENGINE, AND FUEL EMULSION COMPRISING WATER AND A LIQUID HYDROCARBON

CROSS REFERENCE TO RELATED APPLICATION

This application is a national phase application based on PCT/EP02/03534, filed Mar. 28, 2002, the content of which is incorporated herein by reference.

BACKGROUND OF THE INVENTION

1. Field of the Invention

The present invention relates to a method for reducing emission of pollutants from an internal combustion engine, particularly from a diesel engine, and to a fuel emulsion comprising water and a liquid hydrocarbon.

1. Description of the Related Art

It is known that the combustion of liquid hydrocarbons in an internal combustion engine (e.g. a diesel engine) leads to the formation of numerous pollutants, in particular soot, particulates, carbon monoxide (CO), nitrogen oxides (NOx), sulphur oxides (SOx), and non-combusted hydrocarbons (HC), which cause a remarkable atmospheric pollution.

It is also known that the addition of controlled amounts of water to a fuel can significantly reduce the production of pollutants. It is believed that this effect is the result of various phenomena arising from the presence of water in the combustion zone. For example, the lowering of the peak combustion temperature by water reduces the emission of nitrogen oxides (NOx), the formation of which is promoted by high temperatures. In addition, the instantaneous vaporization of the water droplets promotes better dispersion of the fuel in the combustion chamber, thereby significantly reducing the formation of soot, particulates and CO. These phenomena take place without adversely affecting the yield for the combustion process.

Several solution have been proposed to add water to liquid fuel at the time of use, i.e. just before the fuel is injected into the combustion chamber, or directly into the chamber itself. However, these solutions require modifications to be made to the structure of the engine and are not capable of achieving optimum dispersion of the water in the fuel, which is an essential requisite for obtaining a significant reduction in pollutants without compromising the calorific yield for the process.

Thus, the most promising and numerous efforts made hitherto were directed towards the formulation of emulsions between liquid hydrocarbons and water in the presence of emulsifiers (surfactants) for the purpose of uniformly dispersing the water in the hydrocarbon phase in the form of droplets of the smallest possible size.

For example, European Patent Application EP-A-475,620 describes microemulsions of a diesel fuel with water, which contain a cetane improver and an emulsifying system comprising a hydrophilic surfactant and a lipophilic surfactant. These surfactants are selected from ethoxylated $C_{12}$-$C_{18}$ alkylammonium salts of a $C_9$-$C_{24}$ carboxylic or sulphonic acid: the hydrophilic surfactant contains at least six ethylene oxide units, while the lipophilic surfactant contains less than six ethylene oxide units.

European Patent Application EP-A-630,398 describes a fuel in the form of an emulsion consisting of a hydrocarbon fuel, from 3 to 35% by weight of water and at least 0.1% by weight of an emulsifying system consisting of a sorbitan oleate, a polyalkylene glycol and an ethoxylated alkylphenol.

International Patent Application WO 97/34969 describes an emulsion between water and a hydrocarbon, for example a diesel fuel. This emulsion is stabilized by adding an emulsifier consisting of a sorbitan sesquioleate, a polyethylene glycol monooleate and an ethoxylated nonylphenol. This emulsifier has an overall HLB (hydrophilic-lipophilic balance) value of from 6 to 8.

A process for producing a stabilized emulsion of a liquid fuel and water is described in European Patent Application EP-A-812,615. This process involves preparing a first emulsion by mixing the fuel, the water and a surfactant, and subsequently mixing the emulsion thus obtained with more water to give the final emulsion. The emulsion is stabilized using a hydrophilic surfactant or a lipophilic surfactant, or a mixture thereof. Lipophilic surfactants which can be used are fatty acid esters of sorbitol, for example sorbitan monooleate, while hydrophilic surfactants which are suitable for this purpose are fatty acid esters of sorbitol containing a polyoxyalkylene chain, for example polyoxyethylene sorbitan trioleate. Further stabilization of the emulsion can be obtained by adding ethylene glycol or a polyethylene glycol.

International Patent Application WO 92/19701 describes a process for reducing the emission of NOx from a gas turbine, in which an emulsion of water with a diesel fuel is used. The emulsion is stabilized by adding an emulsifier selected from: alkanolamides obtained by condensing an alkylamine or hydroxyalkylamine with a fatty acid; and ethoxylated alkylphenols. The emulsifier preferably has a HLB value of less than or equal to 8. Physical stabilizers such as waxes, cellulose derivatives or resins can be added to improve the stability. As described in patent application WO 93/07238, the above emulsion can be further stabilized by adding a difunctional block polymer with a primary hydroxyl end group, in particular a copolymer containing propylene oxide/ethylene oxide blocks.

International Patent Application WO 00/15740 describes an emulsified water-blended fuel composition comprising: (A) a hydrocarbon boiling in the gasoline or diesel range; (B) water; (C) a minor emulsifying amount of at least one fuel-soluble salt made by reacting (C) (I) at least one acylating agent having about 16 to 500 carbon atoms with (C) (II) ammonia and/or at least one amine; and (D) about 0.001 to about 15% by weight of the water-blended fuel composition of a water soluble, ashless, halogen-, boron-, and phosphorus-free, amine salt, distinct from component (C). The acylating agent (C) (I) includes carboxylic acids and their reactive equivalents such as acid halides, anhydrides, and esters, including partial esters and triglycerides. The fuel may also comprise other components such as: cosurfactants selected from ionic or non-ionic compounds having a HLB of from 2 to 10, preferably of from 4 to 8; organic cetane improvers, including nitrate esters of substituted or unsubstituted aliphatic or cycloaliphatic alcohols; antifreeze agents, usually an alcohol such as ethylene glycol, propylene glycol, methanol, ethanol, and mixtures thereof, in a an amount of from 0.1% to 10%, preferably from 0.1 to 5%, by weight of the fuel composition.

International Patent Application WO 01/51593 describes a fuel comprising an emulsion between water and a liquid hydrocarbon, and further comprising as emulsifier a polymeric surfactant obtainable by reaction between: (i) a polyolefin oligomer functionalized with at least one group deriving from a dicarboxylic acid, or a derivative thereof; and (ii) a polyoxyalkylene comprising linear oxyalkylene units, said polyoxyalkylene being linked to a long-chain alkyl group optionally containing one or more ethylenic unsaturations. The fuel may also comprise an alcohol as antifreeze agent, such as methanol, ethanol, isopropanol, or a glycol, in an amount generally from 0.5 to 8% by weight, preferably from 1 to 4% by weight, with respect to the total weight of the fuel.

A reduction of NOx exhaust emissions from a diesel engine can also be obtained by controlling the functioning of the engine so as to obtain a reduction of the peak combustion temperature.

Such a reduction may be obtained for instance by recirculation of a portion of the exhaust gases into the engine intake manifold where it mixes with the incoming air/fuel charge. By diluting the air/fuel mixture under these conditions, peak combustion temperatures are reduced, resulting in an overall reduction of NOx output. Such systems are commonly known as Exhaust Gas Recirculation (EGR) systems. The first EGR systems were introduced in the early '70s as on/off devices. However, continuous recirculation of the exhaust gases resulted in unstable engine operation, decreased power output and oil contamination due to the presence of particulates in the recirculated gases. Upon introduction of close loop computer controls for engines, the EGR systems were remarkably improved by controlling the rate or amount of recirculated exhaust gases in a manner responsive to operating conditions of the engine, particularly-during acceleration. For a general review on EGR systems see for instance "Emission Controls: Part II: GM Exhaust Gas Recirculation Systems" by M. Schultz, published in *Motor*, Vol. 159 (February 1983), pages 15 ff, and also U.S. Pat. Nos. 3,796,049 and 4,454,854.

Another system for reducing the peak p combustion temperature, and thus the NOx emissions, by controlling the functioning of the engine is based on an electronic control of the injection timing in the combustion chamber. Particularly, delayed injection reduces NOx emissions, while excessive delay results in higher fuel consumption and HC emissions. Therefore, a precise injection timing is necessary, which is guaranteed by an electronic diesel-control system (EDC). A crankshaft reference point provides the basis for regulating the timing device setting. Extremely high precision can be achieved by monitoring the start of injection directly at the injection nozzle by employing a needle-motion sensor to monitor the needle-valve movement (control of start of injection) (see for instance U.S. Pat. No. 5,445,128).

Another known method to reduce NOx in exhaust gases is based on cooling compressed intake air in turbocharged engines, so as to reduce combustion temperatures in the engine, with a consequent decrease of NOx emissions. A method of this kind is disclosed for instance in U.S. Pat. No. 6,145,498.

For a general review on engine measures to reduce exhaust emissions from diesel engines see for instance "Bosch Automotive Handbook", 4th Edition, October 1996 (pages 530-535).

In order to meet the requirements of increasingly more stringent emission standards, some attempts have been made to combine different technologies of emission reduction.

For instance, U.S. Pat. No. 4,479,473 a system for controlling emissions from a diesel engine is disclosed by controlling the recirculation of engine exhaust gases into the intake manifold and by modulating the injection timing schedule of the engine fuel injection pump.

U.S. Pat. No. 5,271,370 discloses an emulsion fuel engine having at least one cylinder with an injection nozzle for injecting an emulsion fuel, which has been formed by mixing a first fuel with a second fuel, into the cylinder. The engine comprises exhaust gas recirculation means for returning a portion of exhaust gas to an intake passage to recirculate the exhaust gas; and exhaust gas recirculation control means for controlling the amount of the exhaust gas to be recirculated. Therefore, water and diesel fuel are mixed for the first time when the engine is operated by the emulsion fuel. Alternatively, an emulsion fuel prepared in advance by mixing diesel fuel and water and stored in an emulsion fuel tank can be delivered to the injection nozzle and then injected into the cylinder.

SUMMARY OF THE INVENTION

The Applicant has felt the need of combining techniques for controlling the peak combustion temperature such as those described above with the use of a fuel emulsion which can be fed to the combustion chamber without introducing further modifications to the engine.

Moreover, the Applicant has perceived the importance of providing a fuel emulsion containing a reduced amount of water without decreasing the capability of the fuel emulsion to reduce pollutants emission, particularly particulate emission.

The Applicant has now found that the above goal and other remarkable improvements may be achieved by fueling an internal combustion engine whose functioning is controlled so as to obtain a reduction of the peak combustion temperature with a fuel emulsion comprising a liquid hydrocarbon fuel, water, at least one emulsifier and at least one oxygen-containing water soluble organic compound. The use of this fuel emulsion allows to obtain a considerable reduction of particulate emissions while maintaining or even further reducing the NOx level which is already reduced by the engine itself. A reduced amount of water in the fuel emulsion is of great importance, since it allows not to substantially affect the power output of the engine, thus allowing the use of the fuel emulsion also in applications where the power loss is a constraint, such as heavy load trucks and passenger cars. Moreover, in the case of EGR systems, a low level of particulate emission allows to reduce oil contamination.

Therefore, in a first aspect the present invention relates to a method for reducing emission of pollutants from an internal combustion engine including at least one combustion chamber, comprising:

injecting a fuel emulsion into the at least one combustion chamber;

igniting the fuel emulsion in the at least one combustion chamber in the presence of air;

operating the internal combustion engine so as to reduce peak combustion temperature in the at least one combustion chamber;

wherein the fuel emulsion comprises a liquid hydrocarbon fuel, water, at least one emulsifier and at least one oxygen-containing water soluble organic compound.

According to a preferred embodiment, operating the internal combustion engine so as to reduce peak combustion temperature in the at least one combustion chamber comprises recirculating a portion of exhaust gases produced during ignition into the at least one combustion chamber.

According to another preferred embodiment, operating the internal combustion engine so as to reduce peak combustion temperature in the at least one combustion chamber comprises controlling injection timing of the fuel emulsion in the combustion chamber.

According to another preferred embodiment, operating the internal combustion engine so as to reduce peak combustion temperature in the at least one combustion chamber comprises compressing and cooling intake air before entering the combustion chamber.

According to a preferred embodiment, in the method according to the present invention the amount of water in the fuel emulsion is not greater than 15% by weight, preferably from 2 to 12% by weight, more preferably from 2.5 to 10% by weight, even more preferably from 3 to 8% by weight.

According to another preferred embodiment, in the method according to the present invention the amount of oxygen-containing water soluble organic compound is predetermined so as to obtain an amount of water soluble organic oxygen of from 0.1 to 5% by weight, preferably from 0.3 to 4% by weight, more preferably from 0.5 to 2.5% by weight, even more preferably from 0.8 to 2% by weight.

Unless otherwise specified, in the present description and claims the amounts are expressed as % by weight with respect to the total weight of the fuel emulsion.

In another aspect, the present invention relates to a fuel emulsion comprising a liquid hydrocarbon fuel, water, at least one emulsifier and at least one oxygen-containing water soluble organic compound as additive for reducing emission of pollutants, especially of particulate, wherein the amount of water in the fuel emulsion is not greater than 15% by weight, preferably from 2 to 12% by weight, more preferably from 2.5 to 10% by weight, even more preferably from 3 to 8% by weight, and the amount of oxygen-containing water soluble organic compound is predetermined so as to obtain an amount of water soluble organic oxygen of from 0.1 to 5% by weight, preferably from 0.3 to 4% by weight, more preferably from 0.5 to 2.5% by weight, even more preferably from 0.8 to 2% by weight.

In another aspect, the present invention relates to a method for reducing emission of pollutants, especially of particulate, from an internal combustion engine fuelled by a fuel emulsion comprising a hydrocarbon phase and an aqueous phase dispersed in the hydrocarbon phase, the method comprising adding to the fuel emulsion at least one oxygen-containing water soluble organic compound so as to obtain a predetermined amount of water soluble organic oxygen in the aqueous phase.

In another aspect, the present invention relates to the use of an oxygen-containing water soluble organic compound to reduce emission of pollutants, particularly of particulate, from an internal combustion engine fuelled by a fuel emulsion.

The Applicant wishes to point out that the fuel emulsions according to the present invention are particularly suitable for use in fuel distribution networks dedicated to fuelling of heavy load trucks and/or passenger cars, where the need of a fuel which is able to reduce pollutant emissions, especially particulate, without substantially affecting the power output of the engine is requested.

Therefore, according to another aspect, the present invention relates to the use a fuel emulsion comprising a liquid hydrocarbon fuel, water, at least one emulsifier and at least one oxygen-containing water soluble organic compound as fuel in a distribution network for fuelling heavy load trucks and/or passenger cars.

DETAILED DESCRIPTION OF THE INVENTION

The amount of water soluble organic oxygen is the amount of oxygen linked to the oxygen-containing water soluble organic compound dissolved in the aqueous phase of the fuel emulsion. It can be determined on the basis of the number of oxygen atoms contained in the water soluble compound, assuming that the overall amount of that compound added to the fuel emulsion is dissolved in the aqueous phase.

The water soluble compound according to the present invention (for the sake of conciseness identified herein also as "water soluble compound") is a non-ionic organic compound having at least one oxygen-containing group, soluble in water at 20° C., usually not containing other heteroatoms such as sulfur, nitrogen, phosphorus, halogens. Preferably the oxygen-containing group may be selected from: hydroxyl group, ether group, ester group, ketone group, peroxy group, and combinations thereof.

Preferably, the water soluble compound has a solubility in water at 20° C. of at least 5% by weight, more preferably of at least 8% by weight.

The oxygen-containing water soluble organic compound according to the present invention may be selected from:

(i) alcohols, such as; methanol, ethanol, 1-propanol, 2-propanol, 1-butanol, 2-butanol, 2-methyl-1-propanol, diacetone alcohol, furfuryl alcohol;

(ii) glycols such as: ethylene glycol, diethylene glycol, triethylene glycol, 1,2-propylene glycol, 1,3-propylene glycol, dipropylene glycol, 1,2-butanediol, 1,3-butanediol, 1,4-butanediol, 2,3-butanediol, 1,5-pentanediol, 2,2-dimethyl-1,3-propanediol, 2,3-hexanediol, 1,3-propanediol, 2,3-hexandiol, polyethylene glycol;

(iii) polyols such as: glycerol, diglycerol, sorbitol, glycerol 2-methylether, glycerol trimethylether, glycerol monoacetate, fructose, galactose, sucrose, pentaerythritol, dipentaerythritol, tripentaerythritol;

(iv) esters such as: ethyl acetate, methyl acetate, butyl acetate, ethyl acetoacetate, ethylene glycol acetate, ethylene glycol diacetate, methyl lactate, ethyl lactate, glycerol-monoacetate, isopropyllactate, methylformate, ethylformate, butylformate, isopropylformate;

(v) ethers, such as: ethylene glycol diethylether, ethylene glycol monoethylether, ethylene glycol monoisopropylether, ethylene glycol monobutylether, diethylene glycol dimethylether, diethylene glycol monoethylether, ethylene glycol dimethylether, ethylene glycol monobutylether, triethylene glycol monoethylether, triethylene glycol dimethylether, tetraethylene glycol dimethylether, polyethylene glycol dimethylether;

(vi) ketones, such as: 2-propanone, 2-pentanone, 3-pentanone, 2-methyl-3-pentanone, 3-hydroxy-2-pentanone, 4-hydroxy-2-pentanone, 5-hydroxy-2-pentanone;

or mixtures thereof.

The fuel emulsions according to the present invention comprises at least one emulsifier. The emulsifier, or the combination of emulsifiers, has a hydrophilic-lipophilic balance (HLB) of from 2 to 10, preferably from 3 to 8.

The emulsifier is generally soluble in the hydrocarbon fuel and may be selected from one of the following classes of products:

(a) a product obtained by reacting (a1) a polyolefin oligomer functionalized with at least one group deriving from a dicarboxylic acid, or a derivative thereof, with (a2) a polyoxyalkylene comprising linear oxyalkylene units, said polyoxyalkylene being linked to a long-chain alkyl group optionally containing one or more ethylenic unsaturation;

(b) a product obtained by reacting (b1) a hydrocarbyl substituted carboxylic acid acylating agent with (b2) ammonia or an amine, the hydrocarbyl substituent of said acylating agent having from 50 to 500 carbon atoms.

Other emulsifiers my be selected from: alkanolamides, alkylarylsulfonates, amine oxides, poly(oxyalkylene)compounds (including ethyleneoxide-propyleneoxide block copolymers), carboxylated alcohol ethoxylates, ethoxylated alcohols, ethoxylated alkyl phenols, ethoxylated amines and amides, ethoxylated fatty acids, ethoxylated fatty esters and oils, fatty esters, glycerol esters, glycol esters, imidazoline derivatives, lecithin and derivatives, lignin and derivatives, monoglycerides and derivatives, olefin sulfonates, phosphate esters and derivatives, propoxylated and ethoxylated fatty acids or alcohols or alkylphenols, sorbitan derivatives, sucrose esters and derivatives, sulfates or alcohols or ethoxylated alcohols or fatty esters, and mixtures thereof.

More details on emulsifiers that can be used in the present invention can be found in EP-A-475,620, EP-A-630,398, WO 97/34969, EP-A-812,615, WO 92/19701, WO 93/07238, WO 00/15740 and WO 01/51593, which are herein incorporated by reference.

The amount of the at least one emulsifier to be used in the fuel emulsion according to the present invention is predetermined mainly as a function of the amount of water to be emulsified and of the type of liquid hydrocarbon fuel. Preferably, the at least one emulsifier is used in an amount of from 0.1 to 10% by weight, preferably from 0.5 to 5% by weight.

The fuel emulsion according to the present invention is generally of the water-in-oil type, wherein the water droplets are dispersed in the continuous hydrocarbon phase.

The fuel according to the present invention includes a liquid hydrocarbon fuel, generally deriving from the distillation of petroleum and consisting essentially of mixtures of aliphatic, naphthenic, olefinic and/or aromatic hydrocarbons. The liquid hydrocarbon generally has a viscosity at 40° C. of from 1 to 53 cSt, and a density at 15° C. of from 0.75 to 1.1 kg/dm$^3$, and can be selected, for example, from: gas oils for use as automotive fuels or for production of heat, fuel oils, kerosenes, aviation fuels (Jet Fuels).

The water to be used in the fuel emulsion can be of any type, for example industrial or domestic mains water. However, it is preferred to use demineralized or deionized water, in order to avoid the formation of mineral deposits on the internal surface of the combustion chamber and/or on the injectors.

The fuel emulsion according to the present invention may contain other additives, such as: cetane improvers, corrosion inhibitors, lubricants, biocides, antifoaming agents, and mixtures thereof.

In particular, the cetane improvers are products which improve the detonating properties of the fuel, and are generally selected from nitrates, nitrites and peroxides of the organic or inorganic type, which are soluble in the aqueous phase or, preferably, soluble in the hydrocarbon phase, such as organic nitrates (see for example patents: EP-475,620 and U.S. Pat. No. 5,669,938). Of preferred use are alkyl or cycloalkyl nitrates containing up to 10 carbon atoms, such as: ethyl nitrate, amyl nitrates, n-hexyl nitrate, 2-ethylhexyl nitrate, n-decyl nitrate, cyclohexyl nitrate and the like, or mixtures thereof.

The biocides can be selected from those known in the art, such as morpholine derivatives, isothiazolin-3-one derivatives, tris(hydroxymethyl)nitromethane, formaldehyde, oxazolidines, bronopol (2-bromo-2-nitro-1,3propandiol), 2-phenoxyethanol, dimethylolurea, or mixtures thereof.

The oxygen-containing water soluble organic compound which is added to the fuel emulsion according to the present invention may act also as antifreeze. However, for some applications it could be advisable to add to the fuel emulsion also an antifreeze selected from those available in the art.

The fuel emulsions according to the present invention may also include at least one water soluble amine or ammonia salt, such as ammonium nitrate, ammonium acetate, methylammonium nitrate, methylammonium acetate, ethylene diamine diacetate, urea nitrate, urea dinitrate, or mixtures thereof, in ana mount of from 0.001% to 15% by weight (see WO 00/15740).

The fuel emulsion according to the present invention is generally prepared by mixing the components using an emulsifying device, in which the formation of the emulsion can result from a mechanical-type action exerted by moving parts, or from passing the components to be emulsified into mixing devices of static type, or alternatively from a combined mechanical and static action. The emulsion is formed by feeding the aqueous phase and the hydrocarbon phase, optionally premixed, into the emulsifying device. The emulsifier and the other additives which may be present can be introduced separately or, preferably, premixed either in the aqueous phase or in the hydrocarbon phase depending on their solubility properties. Preferably, the oxygen-containing water soluble organic compound is premixed in the aqueous phase, while the emulsifier is premixed in the hydrocarbon phase.

The present invention will now be further illustrated by means of some working examples.

The fuels having the compositions reported in Table 1 were tested on a diesel engine used on cars Volkswagen Passat 1.9 TDI 130 cv, having an EGR system and a fuel injection unit pump. The engine was tested on a chassis rolls dynamometer according to the European standard ECE R15+EUDC. The measurement cycle reproduced a urban driving cycle (ECE) combined with an extra-urban driving (EUDC) segment to account for more aggressive, high speed driving modes. The emissions were measured according to that standard and expressed as grams of pollutant per km of route.

The results are reported in Table 2.

TABLE 1

| FUEL | 1 | 2 | 3 | 4 | 5 |
|---|---|---|---|---|---|
| Diesel Fuel EN590 | 100 | 86.22 | 90.22 | 87.22 | 92.22 |
| Water | — | 12.00 | 8.00 | 8.00 | 4.00 |
| Emulsifier | — | 1.60 | 1.60 | 1.60 | 1.60 |
| MEG | — | — | — | 3.00 (*) | 2.00 (**) |
| Cetane Improver | — | 0.15 | 0.15 | 0.15 | 0.15 |
| Bactericide | — | 0.03 | 0.03 | 0.03 | 0.03 |

The compositions are expressed as % by weight.

Emulsifier: obtained by reacting a polyoxyethylene-fatty acid monoester with a polyisobutene functionalized with maleic anhydride (according to Example 1 of WO 01/51593);

MEG: monoethyleneglycol;

Cetane improver: 2-ethylhexyl nitrate;

Bactericide: isothiazolin-3-one derivative.

(*) corresponding to 1.55% by weight of water soluble organic oxygen;

(**) corresponding to 1.03% by weight of water soluble organic oxygen.

TABLE 2

| FUEL | 1 | 2 | 3 | 4 | 5 |
|---|---|---|---|---|---|
| NO*x* (g/km) | 0.448 | 0.404 | 0.345 | 0.375 | 0.362 |
| Particulate (g/km) | 0.035 | 0.020 | 0.020 | 0.010 | 0.013 |
| CO (g/km) | 0.276 | 0.422 | 0.356 | 0.400 | 0.201 |

The invention claimed is:

1. A method for reducing emission of pollutants from an internal combustion engine including at least one combustion chamber, comprising:

injecting a fuel emulsion comprising a liquid hydrocarbon fuel, water, at least one emulsifier and at least one oxygen-containing water soluble organic compound into the at least one combustion chamber, wherein the at least one emulsifier is selected from a product obtained by reacting (a1) a polyolefin oligomer functionalized with at least one group deriving from a dicarboxylic acid, or a derivative thereof, with (a2) a polyoxyalkylene comprising linear oxyalkylene units, said polyoxyalkylene being linked to a long-chain alkyl group optionally containing one or more ethylenic unsaturation, and wherein the at least one oxygen-containing water soluble organic compound is selected from mono-, di-, and tri-alkylene glycols, and mixtures thereof;

igniting the fuel emulsion in the at least one combustion chamber in the presence of air; and operating the internal combustion engine so as to reduce peak combustion temperature in the at least one combustion chamber with a method selected from:

(i) recirculating a portion of exhaust gases produced during ignition into the at least one combustion chamber, (ii) controlling injection timing of the fuel emulsion in the combustion chamber, and (iii) compressing and cooling intake air before entering the combustion chamber.

2. The method according to claim 1, wherein the water is present in an amount not greater than 15% by weight.

3. The method according to claim 2, wherein the water is present in an amount of 2 to 12% by weight.

4. The method according to claim 3, wherein the water is present in an amount of 2.5 to 10% by weight.

5. The method according to claim 4, wherein the water is present in an amount of 3 to 8% by weight.

6. The method according to claim 1, wherein the oxygen-containing water soluble organic compound is present in a predetermined amount so as to obtain an amount of water soluble organic oxygen of 0.1 to 5% by weight.

7. The method according to claim 6, wherein the oxygen-containing water soluble organic compound is present in a predetermined amount so as to obtain an amount of water soluble organic oxygen of 0.3 to 4% by weight.

8. The method according to claim 7, wherein the oxygen-containing water soluble organic compound is present in a predetermined amount so as to obtain an amount of water soluble organic oxygen of 0.5 to 2.5% by weight.

9. The method according to claim 8, wherein the oxygen-containing water soluble organic compound is present in a predetermined amount so as to obtain an amount of water soluble organic oxygen of 0.8 to 2% by weight.

10. The method according to claim 1, wherein the oxygen-containing water soluble organic compound has a solubility in water at 20° C. of at least 5% by weight.

11. The method according to claim 10, wherein the oxygen-containing water soluble organic compound has a solubility in water at 20° C. of at least 8% by weight.

12. The method according to claim 1, wherein the emulsifier has a hydrophilic-lipophilic balance (HLB) of 2 to 10.

13. The method according to claim 12, wherein the emulsifier has a hydrophilic-lipophilic balance (HLB) of 3 to 8.

14. The method according to claim 1, wherein the emulsifier is present in an amount of 0.1 to 10% by weight.

15. The method according to claim 14, wherein the emulsifier is present in an amount of 0.5 to 5% by weight.

16. The method according to claim 1, further comprising reducing pollution in the form of particulates.

* * * * *